US006736468B1

(12) United States Patent
Wilson

(10) Patent No.: US 6,736,468 B1
(45) Date of Patent: May 18, 2004

(54) LOCKABLE FURNITURE ARTICLE FOR STORAGE OF PERSONAL ITEMS

(75) Inventor: Daniel M. Wilson, Axton, VA (US)

(73) Assignee: American Furniture Company, Martinsville, VA (US)

( * ) Notice: Subject to any disclaimer, the term of this patent is extended or adjusted under 35 U.S.C. 154(b) by 0 days.

(21) Appl. No.: 10/330,452

(22) Filed: Dec. 27, 2002

(51) Int. Cl.[7] ..... E05B 65/46
(52) U.S. Cl. ..... 312/217; 312/218
(58) Field of Search ..... 312/216, 217, 312/218, 219, 220, 221

(56) References Cited

U.S. PATENT DOCUMENTS 2,709,123 A * 5/1955 Benjamin ..... 312/221
2,842,419 A * 7/1958 Howard ..... 312/218
2,966,384 A * 12/1960 Bergman ..... 312/218
3,883,199 A * 5/1975 Cawley et al. ..... 312/216
4,092,056 A * 5/1978 Signore et al. ..... 312/219
4,705,326 A * 11/1987 Craig ..... 312/221
4,966,422 A * 10/1990 Albright et al. ..... 312/218
5,533,798 A * 7/1996 Feldpausch et al. ..... 312/219

* cited by examiner

*Primary Examiner*—Peter R. Brown
(74) *Attorney, Agent, or Firm*—Harness, Dickey & Pierce, P.L.C.

(57) ABSTRACT

An article of furniture having a set of lockable drawers, a vertically-actuated lock rod, which has a plurality of extending lock members, and a plurality of dog members. Each of the dog members is coupled to a sidewall of an associated drawer and includes a resilient trailing portion. When the lock rod is positioned in an unlocked position, the lock members and the dog members do not cooperate to inhibit the movement of the drawers. When the lock rod is positioned in a locked position, the lock members are positioned horizontally in-line with the dog members. Contact between a lock member and the trailing edge of a dog member inhibits the opening of a drawer. The resilient construction of the dog member permits the drawers to be closed when the lock rod is positioned in the lock position.

14 Claims, 4 Drawing Sheets

LOCKABLE FURNITURE ARTICLE FOR STORAGE OF PERSONAL ITEMS

FIELD OF THE INVENTION

The present invention generally relates to storage furniture and more particularly to articles of furniture having one or more drawers that are selectively securable through a hand-actuated (i.e., non-keyed) means that is readily concealed within another accessible and selectively closable portion of the furniture article.

BACKGROUND OF THE INVENTION

There is a need in many institutional settings for articles in which one may store their personal articles and possessions in a convenient and relatively secure manner. Several known storage articles, such as footlockers for example, are relatively common place in institutional settings as they tend to be relatively inexpensive and are compatible with locking devices, such as hasp mechanisms that are configured to receive a discrete lock (e.g., a padlock or combination lock) that is provided by the user of the storage article.

As those skilled in the art will appreciate, it is usually not desirable to provide a storage article in an institutional setting wherein the user of the storage article must rely on a lock mechanism (e.g., a key actuated latch mechanism) that has been incorporated into the storage article, since the relatively transient use of the storage article can raise issues of security and maintenance. For example, the present user of the storage article cannot be sure that a prior user of the storage article did not make a copy of the key that unlatches the lock mechanism. As such, the present user cannot be sure that the contents of the storage article are secure against one possessing a copied key. Furthermore, loss of the key and/or maintenance of the latch mechanism may need to be resolved through a locksmith. In contrast, a user provided, relatively low cost padlock or combination lock tends to negates these concerns since the user may simply remove and replace the lock when confronted with the loss of a key (or forgetting of a combination) or questions about the relative security of a device.

In view of the general reluctance to incorporate an integral lock mechanism into a storage article, storage articles having externally accessible drawers have generally not been produced given a lack of a satisfactory means for locking the drawers. As those skilled in the art will appreciate, there has been a long standing need and desire for a storage article that is equipped with one or more externally accessible drawers and which is securable through a user-provided lock.

SUMMARY OF THE INVENTION

In one preferred form, the present invention provides a article of furniture having a case structure, at least one drawer, a lock structure and a dog member. The case structure has a wall member and defines at least two openings including an upper opening and a lower opening. The drawer is disposed in one of the upper opening and the lower opening and is selectively movable between an open position and a closed position. The drawer includes a lateral sidewall that is spaced laterally apart from the wall member. The lock structure extends between the upper opening and the lower opening and is slidably coupled to the wall member so as to be movable in a generally vertical direction between an unlocked position and a locked position. The lock structure includes at least one extending lock member for each drawer. The dog member is coupled to the lateral sidewall and includes a resilient trailing portion that tapers outwardly from the lateral sidewall. The trailing portion includes a trailing edge. Placement of the lock structure in the unlocked position orients the lock member into a position where the lock member does not cooperate with the dog member to maintain the drawer in the closed position or otherwise inhibit movement of the drawer between the closed position and the open position. Placement of the lock structure in the locked position orients the lock member into a position where it is horizontally aligned to the dog member. Movement of the drawer from the open position to the closed position when the lock structure is in the locked position entails contact between the lock member and the trailing edge of the dog member which moves the trailing portion of the dog member toward the sidewall of the drawer. Contact between the trailing edge of the dog member and the lock member inhibits movement of the drawer from the closed position to the open position when the lock structure is in the locked position and the drawer is in the closed position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENTS

Figure 1:
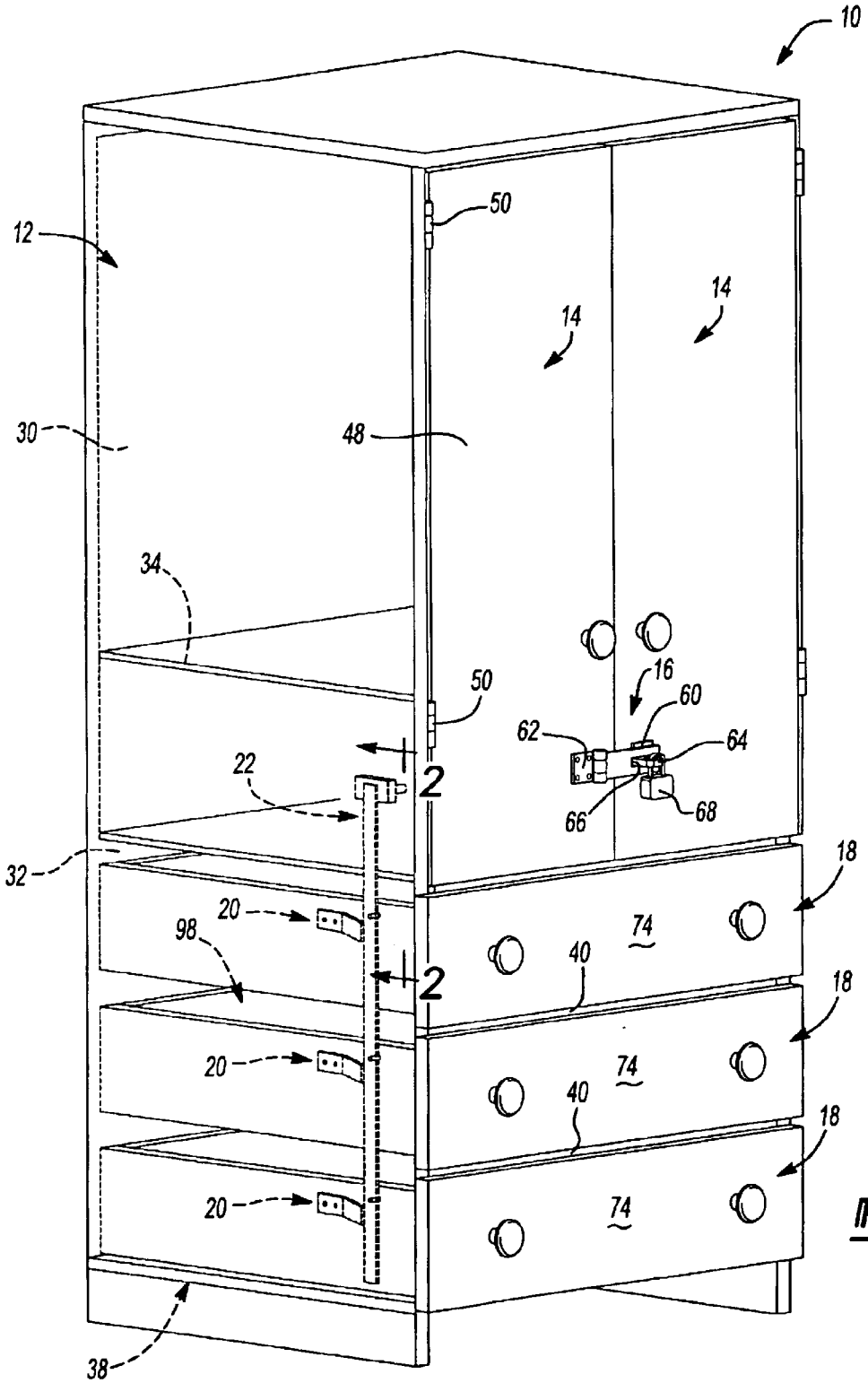
FIG. 1 is a perspective view of an article of furniture constructed in accordance with the teachings of the present invention.

With reference to FIG. 1 of the drawings, a furniture article or case constructed in accordance with the teachings of the present invention is generally indicated by reference numeral 10. The case 10 is illustrated to include a case structure 12, a pair of door assemblies 14, a hasp mechanism 16, a plurality of drawer assemblies 18, a plurality of dog members 20 and a lock rod assembly 22. Except as noted herein, the case structure 12, the door assemblies 14, the hasp mechanism 16 and the drawer assemblies 18 are conventional and as such, their construction and operation need not be discussed in significant detail.

Figure 2:
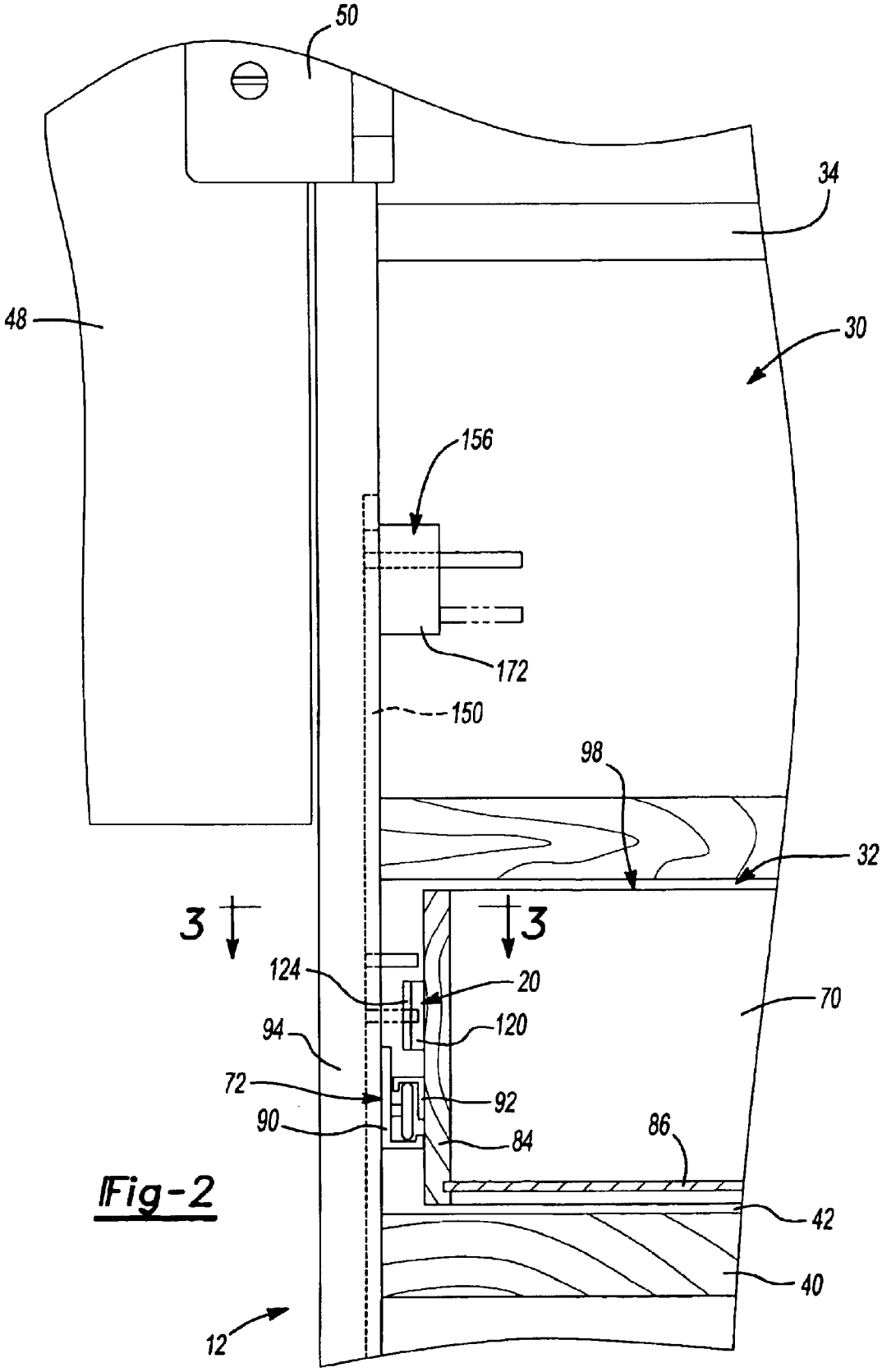
FIG. 2 is a sectional view along the line 2—2 of FIG. 1.

With additional reference to FIG. 2, the case structure 12 is a three-sided structure that defines at least two compartments, including an upper compartment 30 and a lower compartment 32. The upper compartment 30 may be open, or may be configured with conventional components, such as shelves 34 or drawers (not shown), which permit the user to better organize the contents that are to be stored in the upper compartment 30. The shelves 34 or drawers may be fixed in a predetermined position, or may be removably arid adjustably coupled to the case structure 12 through any known means so as to permit the user to customize the storage configuration of the upper compartment 30.

The lower compartment 32 is configured to receive the drawer assemblies 18. In the particular embodiment illustrated, the lower compartment 32 extends continuously between the upper compartment 30 and the base 38 of the case structure 12 and a plurality of horizontally extending stretchers 40 segregate the front of the lower compartment into a plurality of drawer apertures 42. Those skilled in the art will appreciate that the case structure 12 could be alternatively configured to define a plurality of discrete drawer compartments that are arranged in a vertically stacked manner.

Each door assembly 14 includes a conventional door structure 48 and a conventional hinge mechanism 50 that permits the door structure 48 to be pivotably coupled to the case structure 12 so as to be movable between a closed condition (FIG. 1) that at least partially closes the open side of the upper compartment 30, and an open condition (FIG. 2) that substantially clears the open side of the upper compartment 30.

The hasp mechanism 16 conventionally includes a first hasp portion 60 and a second hasp portion 62, each of which is coupled to an associated one of the door assemblies 14. When the door assemblies 14 are in the closed condition so as to inhibit access to the upper compartment 30, the second hasp portion 62 may be pivoted so that it overlaps the first hasp portion 60 so that a securing loop 64 that is carried by the first hasp portion 60 extends through an aperture 66 in the second hasp portion 62. The securing loop 64 is configured to receive a conventional and commercially available padlock 68 or combination lock, which may be employed by the user to selectively restrict access to the upper compartment 30. In cases that include but a single door assembly 14 for closing the open face of the upper compartment 30, the hasp mechanism 16 may be coupled to the door assembly 14 and the case structure 12.

In the particular embodiment provided, each drawer assembly 18 includes a drawer 70, a drawer slide 72 and a drawer front 74. Those skilled in the art, however, will appreciate that the drawer assemblies 18 may be constructed so as not to include a discrete drawer front or a drawer slide. With brief additional reference to FIG. 3, the drawer 70 conventionally includes a front wall 80, a rear wall (not shown), a pair of lateral sidewalls 84 (only one of which is shown) and a drawer bottom 86 that are joined together in a conventional manner such that they cooperate to form a five-sided container with a generally open top.

In FIG. 2, the drawer slide 72 is illustrated to be a,side bottom mount drawer slide, which is commercially available from manufacturers such as Blum, Knape & Vogt or Waterloo, but those skilled in the art will appreciate that other devices, such as wooden, plastic or metal slides or side or undermount glides may also be used. Although only one half of the drawer slide is illustrated, those skilled in the art will appreciate that the other half is a mirror image of that which is shown. Each half of the drawer slide 72 includes first and second slide assemblies 90 and 92, respectively, that engage one another in a telescopic manner. The first slide assemblies 90 are fixedly coupled to the lateral walls 94 of the case structure 12 and second slide assemblies 92 are fixedly coupled to the lateral sidewalls 84 of the drawer 70. When the first slide assemblies 90 are engaged to the second slide assemblies 92, the drawer 70 is movable between a closed position (FIG. 1), wherein the drawer slide 72 is in a retracted position and the open (top) portion 98 of the drawer 70 is located substantially completely within the confines of the lower compartment 32, and an open position, wherein the drawer slide 72 is in an extended position and at least a substantial portion of the top portion 98 of the drawer 70 is located outside the lower compartment 32.

Figure 3:
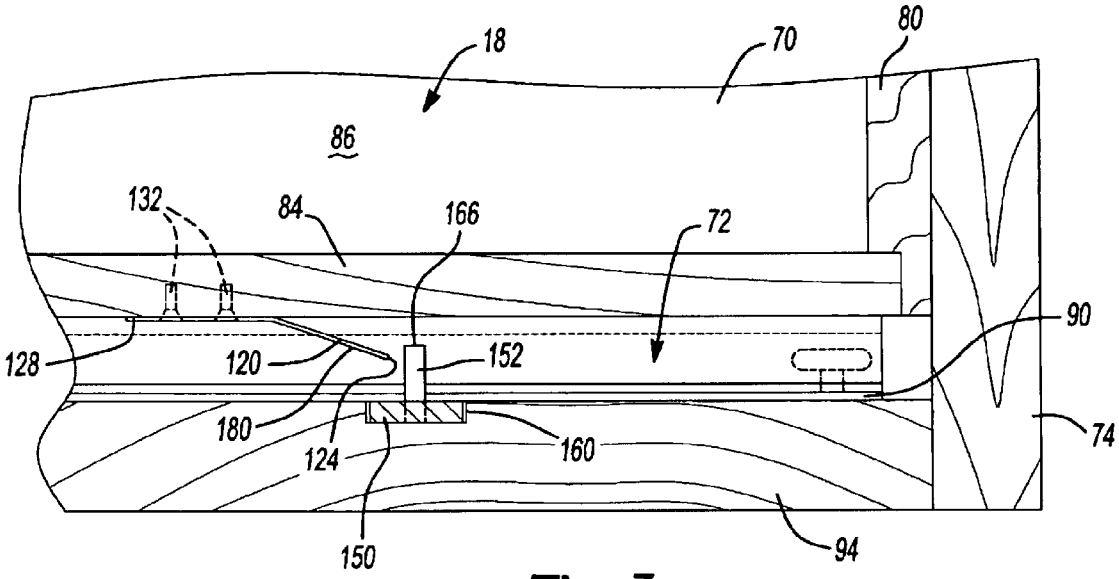
FIG. 3 is a sectional view taken along the line 3—3 of FIG. 2.
Figure 5:
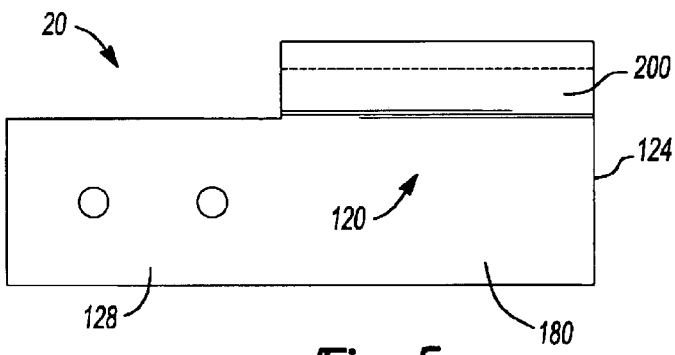
FIG. 5 is a side elevation view of an alternately constructed dog member.
Figure 6:
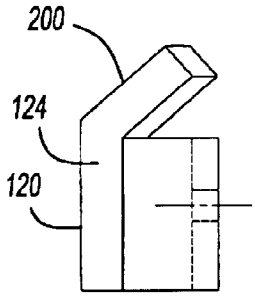
FIG. 6 is a view of the trailing end of the dog member of FIG. 5.
Figure 7:
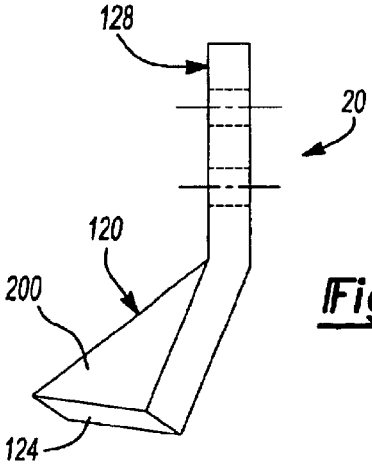
FIG. 7 is a top plan view of another alternately constructed dog member.
Figure 8:
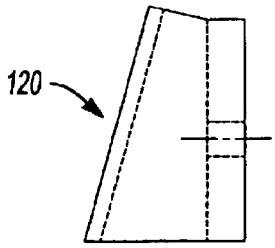
FIG. 8 is a view of the trailing end of the dog member of FIG. 7.
Figure 4:
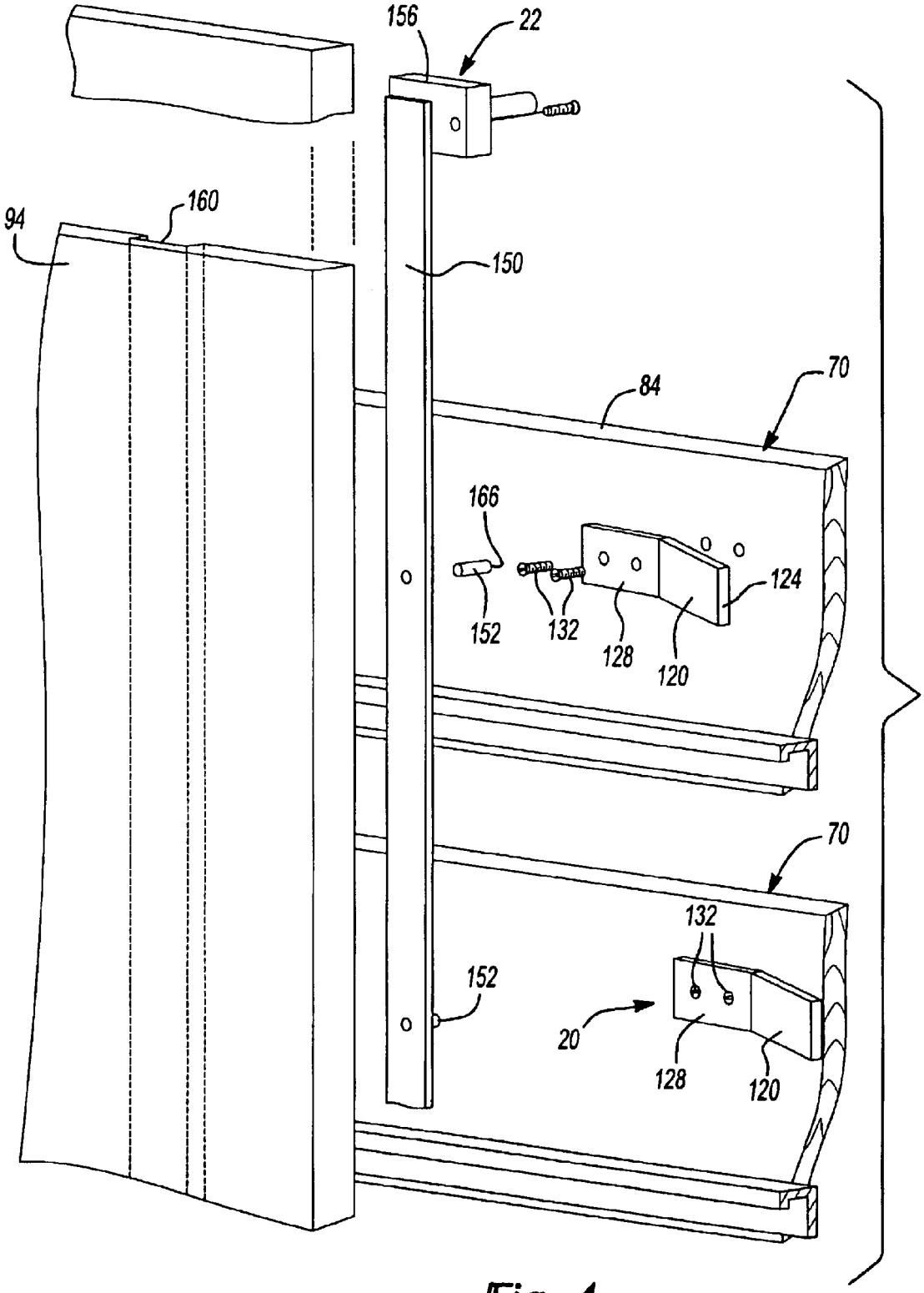
FIG. 4 is an exploded perspective view of the furniture article of FIG. 1.

In FIGS. 3 and 4, the dog members 20 are illustrated to be coupled to the lateral sidewall 84 of an associated drawer 70 and to include a resilient trailing portion 120 that extends outwardly from the lateral sidewall 84 toward the nearest lateral wall 94 of the case structure 12. In the particular example provided, the dog members 20 are formed of spring steel and the trailing portion 120 of each dog member 20 is a generally planar structure that tapers outwardly toward the front wall 80 of the drawer 70 and terminates at a trailing edge 124.

The trailing portion 120 may be coupled directly to a portion of the drawer 70, such as to the lateral sidewall 84 or a mounting block (not shown) that is coupled to the lateral sidewall 84, or it may be coupled to a leading portion 128 that is fixedly coupled to the lateral sidewall 84 as is illustrated. The leading portion 128 provides a means for mounting the trailing portion 120 to the lateral sidewall 84. In the particular example provided, the leading portion 128 is generally planar in its construction, being skewed to the trailing portion 120 and configured to abut the lateral sidewall 84. Any fastening means, such as threaded fasteners 132, unthreaded fasteners and/or adhesives, may be employed to securely, albeit not necessarily fixedly, couple the leading portion 128 to the lateral sidewall 84.

The lock rod assembly 22 includes a lockbar structure 150, a plurality of extending lock members 152 and a detent mechanism 156. The lockbar structure 150 is a relatively narrow and long structure that is mounted in a channel 160 that is formed in the lateral wall 94 of the case structure 12. As the first slide assemblies 90 abut the lateral wall 94, the first slide assemblies 90 effectively limit movement of the lockbar structure 150 in a lateral direction. In other applications, it may be necessary or desirable to more positively secure the lockbar structure 150 to the lateral wall 94 of the case structure 12. In this regard, brackets or shouldered fasteners (i.e., a fastener having a head and a shoulder similar to a shoulder bolt) may be employed in the alternative to wholly or partially capture the lockbar structure 150 to thereby limit its lateral movement.

Each of the extending lock members 152 is coupled to the lockbar structure 150 and extends outwardly therefrom toward the lateral sidewall 84 of an associated drawer 70 so as to be nearer to the lateral sidewall 84 of the drawer 70 than the trailing edge 124 of the trailing portion 120 of the dog member 20 that is coupled to the lateral sidewall 84. In the particular embodiment illustrated, the extending lock members 152 are cylindrical pins having an end face 166 that is generally perpendicular to the longitudinal axis of the pin. Alternatively, the end face 166 may be constructed with a friction reducing feature, such as a chamfer, a fillet radius or a spherical radius to reduce the amount of friction between the end face 166 and the trailing portion 120, which will be discussed in greater detail below.

With reference to FIGS. 2 and 4, the particular detent mechanism 156 illustrated is a SN-300 Snapper, which is commercially available Timberline Lock LTD of Lake Bluff, Ill. However, any appropriately sized and configured detent mechanism may be employed. As detent mechanisms of varied configurations are well known in the art, a detailed discussion of the construction of the detent mechanism 156 is not needed. Briefly, the detent mechanism 156 includes a first portion 170, which is coupled to an upper end of the lockbar structure 150, and a second portion 172, which is coupled to the lateral wall 94 of the case structure 12.

In operation, the first portion 170 of the detent mechanism 156 may be cycled between a first or locked condition (illustrated in phantom in FIG. 2) and a second or unlocked condition (illustrated in solid line in FIG. 2) that is vertically offset from the first condition. When the detent mechanism 156 is positioned in the first condition, the extending lock members 152 are horizontally aligned to the trailing portion 120 of the dog members 20 (i.e., each of the extending lock members 152 lies in a horizontal plane that intersects the trailing portion 120 of an associated dog member 20). When the detent mechanism 156 is positioned in the second condition, the extending lock members 152 are vertically offset from the trailing portion 120 of the dog members 20 (i.e., each of the extending lock members 152 lies in a horizontal plane that does not intersect the trailing portion 120 of any dog member 20). Those skilled in the art will appreciate that while the second condition has been illustrated herein as raised relative to the first condition, the detent mechanism 156 may alternatively be configured so that the second condition is relatively lower than the first condition.

In FIGS. 2 and 3, when the case 10 is in use and, the detent mechanism 156 is positioned in the second condition, the drawers 70 may be freely opened and closed. When the detent mechanism 156 is positioned in the first condition and a drawer 70 is moved from the open position to the closed position, the end face 166 of the extending lock member 152 will contact the outward face 180 of the trailing portion 120 and thereby push the trailing portion 120 inwardly toward the lateral sidewall 84 of the drawer 70. When the trailing edge 124 of the trailing portion 120 clears the extending lock member 152, the resilient nature of the trailing portion 120 permits the trailing portion 120 to return to a state wherein the trailing edge 124 of the trailing portion 120 extends relatively further away from the lateral sidewall 84 than the end face 166 of the extending lock member 152 as shown in FIG. 3.

The extending lock members 152 and the dog members 20 are positioned relative to one another such that the movement of the trailing edge 124 back to the returned state (following contact with the end face 166 of a extending lock member 152) substantially coincides with the drawer 70 being positioned in the closed position. Contact between the extending lock member 152 an the trailing edge 124 of the dog member 20 thus effectively inhibits the reopening of the drawer 70 to any substantial degree. From the foregoing, it will be apparent to those skilled in the art that the actions necessary for locking the drawers 70 may be taken prior to or after the positioning of the drawers 70 into the closed position.

In the event that a drawer 70 is partially closed so that the trailing portion 120 is vertically in-line with a extending lock member 152 as the detent mechanism 156 is being moved toward the first condition, a chamfer or radius on the end face 166 will aid the extending lock member 152 to slide into contact with the outward face 180 of the trailing portion 120 and push the trailing portion 120 inwardly toward the lateral sidewall 84 of the drawer 70. Alternatively the trailing portion 120 of the dog member 20 may be formed as is illustrated in FIGS. 5 and 6 or FIGS. 7 and 8. In these embodiments, the trailing portion 120 is formed in a manner that includes a tapered upper surface 200 that is able to cooperate with a vertically moving (in this case, downward moving) extending lock member 152 to push the trailing portion 120 inwardly toward the lateral sidewall 84 of the drawer 70 to thereby permit the detent mechanism 156 to be fully positioned in the first condition.

With the detent mechanism 156 positioned in the first condition, the user of the case 10 may thereafter close the door structures 48, pivot the second hasp portion 62 over the first hasp portion 60 and employ a padlock 68 or combination lock to thereby inhibit unauthorized access to the upper compartment 30. If any of the drawers 70 are not in the closed position, they may be pushed into the closed position so that the extending lock members 152 will engage the dog members 20 to inhibit unauthorized access to the content of each drawer 70.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. An article of furniture comprising:

a case structure having a wall member, the case structure defining at least two openings including an upper opening and a lower opening, each of the upper and lower openings being adapted to removably receive articles for storage therein;

at least one drawer disposed in one of the upper opening and the lower opening, the drawer being selectively movable between an open position and a closed position, the drawer including a lateral sidewall that is spaced laterally apart from the wall member;

a lock rod having a lock structure and an actuator, the lock structure extending between the upper opening and the lower opening and slidably coupled to the wall member so as to be movable in a generally vertical direction between an unlocked position and a locked position, the lock structure including at least one extending lock member for each drawer, the actuator including an actuator member that is coupled to the lock structure and disposed in a user-accessible area of the other one of the upper opening and the lower opening so as to require a user to reach into the other one of the upper opening and the lower opening to manipulate the actuator member to cause the actuator to move the lock structure from the locked position to the unlocked position; and a dog member for each drawer, the dog member being coupled to the lateral sidewall and including a resilient trailing portion that tapers outwardly from the lateral sidewall, the trailing portion including a trailing edge;

wherein placement of the lock structure in the unlocked position orients the lock member into a position where the lock member does not cooperate with the dog member to maintain the drawer in the closed position or otherwise inhibit movement of the drawer between the closed position and the open position;

wherein placement of the lock structure in the locked position orients the lock member into a position where it is horizontally aligned to the dog member;

wherein movement of the drawer from the open position to the closed position when the lock structure is in the locked position entails contact between the lock member and the trailing edge of the dog member which moves the trailing portion of the dog member toward the sidewall of the drawer; and wherein contact between the trailing edge of the dog member and the lock member inhibits movement of the drawer from the closed position to the open position when the lock structure is in the locked position and the drawer is in the closed position.

2. The furniture article of claim 1, wherein the dog member is formed of spring steel.

3. The furniture article of claim 1, wherein the dog member includes a leading portion that is fixedly coupled to the trailing portion, the leading portion being fixedly secured to the sidewall.

4. The furniture article of claim 3, wherein at least one hole is formed through the leading portion, the hole being sized to receive a threaded fastener therethrough which threadably engages the sidewall.

5. The furniture article of claim 1, wherein the wall member is an exterior wall of the case structure.

6. The furniture article of claim 1, wherein the lock members extend from the same side of the lock structure.

7. The furniture article of claim 1, wherein the wall member includes a channel into which the lock structure is partially disposed.

8. The furniture article of claim 1, wherein the lock structure moves only vertically between the unlocked position and the locked position.

9. The furniture article of claim 1, wherein movement of the lock structure between the unlocked position and the locked position is effected by hand-actuation of the lock structure.

10. The furniture article of claim 1, further comprising at least one door, the door being hingedly coupled to the case structure to selectively close the upper opening.

11. The furniture article of claim 10, further comprising a hasp mechanism, a first portion of the hasp mechanism being coupled to the at least one door, a second portion of the hasp mechanism being coupled to one of a second door and the case structure, the first and second portions of the hasp mechanism being operable for engaging one another and receiving a lock through at least one of the first and second portions of the hasp mechanism to inhibit access to the upper opening.

12. The furniture article of claim 1, wherein at least a top portion of the trailing portion tapers upwardly and inwardly toward the sidewall when the dog member is secured to the sidewall, the at least the top portion being configured to guide an associated one of the lock members over a top edge of the dog member when the lock structure is moved from the unlocked position to the locked position when the trailing portion of the dog member is directly vertically in-line with the lock member.

13. The furniture article of claim 1, wherein the dog member includes an upper portion is coupled to the trailing portion and which tapers inwardly from the trailing portion toward the lateral sidewall.

14. An article of furniture comprising:

a case structure having a wall member, the case structure defining an upper opening and a lower opening, each of the upper and lower openings being adapted to removably receive articles for storage therein;

at least one drawer disposed in the lower opening, the drawer being selectively movable between an open position and a closed position, the drawer including a lateral sidewall that is spaced laterally apart from the wall member;

at least one door hingedly coupled to the case structure and movable between a first position, which permits a user to access the upper opening, and a second position, which inhibits the user from accessing the upper opening;

a lock rod having a lock structure and an actuator, the lock structure extending between the upper opening and the lower opening and slidably coupled to the wall member so as to be movable in a generally vertical direction between an unlocked position and a locked position, the lock structure including at least one extending lock member for each drawer, the actuator including an actuator member that is coupled to the lock structure and disposed in a user-accessible area of the upper opening so as to require the user to reach into the upper opening to manipulate the actuator member to cause the actuator to move the lock structure from the locked position to the unlocked position;

a dog member for each drawer, the dog member being coupled to the lateral sidewall and including a resilient trailing portion that tapers outwardly from the lateral sidewall, the trailing portion including a trailing edge; and a hasp having a first portion and a second portion, the first portion being coupled to the door, the second portion being coupled to another structure that forms the article of furniture, the hasp being configured to removably receive a lock through at least one of the first and second portions to secure the lock to the first and second portions of the hasp to inhibit the door from being moved from the second position to the first position;

wherein placement of the lock structure in the unlocked position orients the lock member into a position where the lock member does not cooperate with the dog member to maintain the drawer in the closed position or otherwise inhibit movement of the drawer between the closed position and the open position;

wherein placement of the lock structure in the locked position orients the lock member into a position where it is horizontally aligned to the dog member;

wherein movement of the drawer from the open position to the closed position when the lock structure is in the locked position entails contact between the lock member and the trailing edge of the dog member which moves the trailing portion of the dog member toward the sidewall of the drawer; and wherein contact between the trailing edge of the dog member and the lock member inhibits movement of the drawer from the closed position to the open position when the lock structure is in the locked position and the drawer is in the closed position.

* * * * *

UNITED STATES PATENT AND TRADEMARK OFFICE

CERTIFICATE OF CORRECTION

PATENT NO. : 6,736,468 B1
DATED : May 18, 2004
INVENTOR(S) : Larry P. LaPointe

It is certified that error appears in the above-identified patent and that said Letters Patent is hereby corrected as shown below:

Column 1,
Line 39, “negates” should be -- negate --;
Line 55, “a” should be -- an --;

Column 3,
Line 10, “arid” should be -- and --;
Line 60, “a,side” should be -- aside --;

Column 5,
Line 3, after “available” insert -- from --;
Lines 52 and 63, “a” should be -- an --;
Line 55, “an” should be -- and --;

Column 7,
Line 67, after “portion” delete “is”.

Column 8,
Line 65, after Claim 14, insert the following Claims 15 and 16;
-- 15. The furniture article of Claim 13, wherein the upper portion is bent about an axis that is generally parallel to the direction in which the drawer slides.
16. The furniture article of Claim 1, wherein the dog member includes an upper portion that causes the trailing portion to deflect inwardly toward the lateral sidewall when the upper portion is positioned vertically in-line with the lock member and the lock member is lowered onto the upper portion of the dog member. --

Signed and Sealed this

First Day of March, 2005

JON W. DUDAS
*Director of the United States Patent and Trademark Office*